US009526961B2

(12) United States Patent
Wallace

(10) Patent No.: US 9,526,961 B2
(45) Date of Patent: Dec. 27, 2016

(54) SOCCER GOAL SECURING APPARATUS AND METHOD

(75) Inventor: Timothy Harold Wallace, Charlotte, NC (US)

(73) Assignee: ABT, INC., Troutman, NC (US)

( * ) Notice: Subject to any disclaimer, the term of this patent is extended or adjusted under 35 U.S.C. 154(b) by 921 days.

(21) Appl. No.: 12/337,309

(22) Filed: Dec. 17, 2008

(65) Prior Publication Data

US 2009/0152419 A1 Jun. 18, 2009

Related U.S. Application Data

(60) Provisional application No. 61/014,317, filed on Dec. 17, 2007.

(51) Int. Cl.

| | |
|---|---|
| ***A63B 69/00*** | (2006.01) |
| ***A63B 63/00*** | (2006.01) |
| ***A63B 71/02*** | (2006.01) |

(52) U.S. Cl.

CPC ..... *A63B 63/004* (2013.01); *A63B 71/023* (2013.01); *A63B 63/008* (2013.01); *A63B 71/028* (2013.01); *A63B 2208/12* (2013.01); *A63B 2210/50* (2013.01)

(58) Field of Classification Search

CPC ..... A63B 69/00

USPC ..... 473/476; 172/378; 211/174; 239/207; D8/396; 441/51; 403/283, 177, 176; 248/539, 227.3, 218.2–218.6, 219.4; 24/134 L, 135 N, 279, 290; 29/259, 270; 70/212; 182/136

See application file for complete search history.

(56) References Cited

U.S. PATENT DOCUMENTS

| | | | | |
|---|---|---|---|---|
| 309,038 | A * | 12/1884 | Flach | 403/393 |
| 557,501 | A * | 3/1896 | Ennis | 182/132 |
| 729,508 | A * | 5/1903 | Phillips | B25B 23/0085 29/259 |
| 855,158 | A * | 5/1907 | Brown | 361/149 |
| 902,470 | A * | 10/1908 | Belloni | B21D 7/06 29/259 |
| 949,066 | A * | 2/1910 | Fowler | 211/174 |
| 1,055,923 | A * | 3/1913 | Landes | 70/212 |
| 1,064,400 | A * | 6/1913 | Timmins | 29/259 |
| 1,139,878 | A * | 5/1915 | McElroy | 72/390.7 |
| 1,258,699 | A * | 3/1918 | Neumaier | 29/259 |
| 1,303,354 | A * | 5/1919 | Miller | 70/212 |
| 1,334,987 | A * | 3/1920 | Carpenter | 70/212 |
| 1,347,809 | A * | 7/1920 | Frisz et al. | 29/259 |
| 1,431,378 | A * | 10/1922 | Derry | 29/259 |
| 1,504,037 | A * | 8/1924 | Furman et al. | 29/270 |
| 1,604,590 | A * | 10/1926 | McNulty | F16L 3/24 248/59 |
| 1,661,938 | A * | 3/1928 | Follingstad | 29/260 |
| 1,783,509 | A * | 12/1930 | Lahey | 138/99 |

(Continued)

OTHER PUBLICATIONS

Webpage download, Kwik Goals, 1997-2007, http://www.kwikgoal.com/uploads/assemble/601.pdf, 17 pages.*

(Continued)

*Primary Examiner* — Gene Kim
*Assistant Examiner* — M Chambers
(74) *Attorney, Agent, or Firm* — Moore & Van Allen PLLC; Henry B. Ward, III

(57) ABSTRACT

Embodiments of the invention provide an apparatus for securing a movable soccer goal to a fixed football goal or other vertical post. When in use, the apparatus functions to prevent the soccer goal from being overturned, thereby, making it considerably safer than an unsecured soccer goal.

8 Claims, 5 Drawing Sheets

(56) References Cited

U.S. PATENT DOCUMENTS

| | | | | | |
|---|---|---|---|---|---|
| 2,165,221 | A * | 7/1939 | Burton | E04G 7/24 | 24/335 |
| 2,821,776 | A * | 2/1958 | Keister | 29/259 | |
| 2,821,777 | A * | 2/1958 | Keister | 29/259 | |
| 2,894,773 | A * | 7/1959 | Noe | D02H 1/00 | 403/385 |
| 2,923,509 | A * | 2/1960 | Kolodin | 248/62 | |
| 3,022,898 | A * | 2/1962 | Loeb | 211/64 | |
| 3,051,424 | A * | 8/1962 | Duhamel | F16L 3/11 | 248/62 |
| 3,107,932 | A * | 10/1963 | Johnson | E04G 7/18 | 24/335 |
| 4,032,246 | A * | 6/1977 | Waara | F16B 7/0493 | 403/390 |
| 4,492,014 | A * | 1/1985 | Alexander | 29/259 | |
| 4,570,835 | A * | 2/1986 | Criqui et al. | 224/414 | |
| 5,035,406 | A * | 7/1991 | Sellers et al. | 267/48 | |
| 6,082,697 | A | 7/2000 | Grunfeld | | |
| 7,331,880 | B2 | 2/2008 | Rogers | | |
| 7,828,678 | B1 * | 11/2010 | Caruso | A63B 63/004 | 473/416 |
| 2006/0199674 | A1 * | 9/2006 | Rogers | A63B 63/004 | 473/446 |
| 2006/0202426 | A1 | 9/2006 | Tennett, Sr. | | |
| 2009/0152419 | A1 * | 6/2009 | Wallace | A63B 63/004 | 248/219.4 |

OTHER PUBLICATIONS

Webpage download, sportsedge, 2007, http://replay.waybackmachine.org/20070126051551/http://sportsedge.com/, 2 pages.*

* cited by examiner

SOCCER GOAL SECURING APPARATUS AND METHOD

FIELD

The invention generally relates to the field of sporting goal structures, and more particularly, embodiments of the invention relate to an apparatus for improving the safety of a movable soccer goal used on a football field by securing the movable soccer goal to a fixed football goal.

BACKGROUND

American-style football fields are often used to play soccer. For example, a high school may have a football field that is surrounded by stands and other spectator facilities, but the school may not have such facilities for soccer. Building a separate soccer field having its own spectator facilities might not be considered an efficient use of a school's limited real estate and financial resources. Therefore, the high school may instead choose to use the football field for both football and soccer games. To temporarily transition a football field into a soccer field, movable soccer goals are placed at each end of the football field near the football goals. Such movable soccer goals, however, are often prone to tip over, sometimes causing injury to players or others. This may be especially true when young children are playing on the field, as young children may be more pone to climb on, jump on, bump, or otherwise attempt to disturb the soccer goal.

Accordingly, there is a long-felt but unmet need to provide a system that enables facility personnel to quickly and easily anchor a movable soccer goal on a football field. Previous attempts at securing movable soccer goals on football fields involve piercing or puncturing the surface of the playing field with a stake or screw-type device. These devices, however, can cause damage to a playing field when the field consists of natural turf, and these devices cannot be used at all on artificial playing surfaces.

BRIEF SUMMARY OF EMBODIMENTS OF THE INVENTION

Embodiments of the invention address the need for a relatively simple and effective device to increase the safety of portable soccer goals without causing damage to playing fields. Furthermore, embodiments of the present invention can be used on any type of playing surface, either natural turf or an artificial playing surface, which can be indoors or outdoors, since at least some embodiments of the present invention do not need to interact with the playing surface to function properly.

More particularly, embodiments of the present invention relate to an apparatus that can secure a movable soccer goal to an essentially vertical member already fixed relative to a playing field or surface. Such a vertical member could be the post of a football goal or other essentially vertical post already in existence proximate to the playing surface. For example, embodiments of the present invention provide a secure means of attaching the lower ground bar of the soccer goal to the football goal vertical member or "gooseneck," as it is sometimes referred to.

For example, embodiments of the invention provide an apparatus for securing a movable soccer goal to a football goal, where the apparatus comprises a securing device capable of simultaneously and removably engaging an essentially horizontal member of a movable soccer goal and a fixed, essentially vertical, member extending from the playing surface. In one embodiment, the fixed essentially vertical member comprises a vertical post of a football goal.

In one embodiment, the securing device includes a hook-shaped member for engaging the essentially horizontal member of the movable soccer goal. In such an embodiment, the securing device may further include a pulling mechanism configured to pull the hook-shaped member toward the fixed essentially vertical member to secure the essentially horizontal member between the hook-shaped member and the fixed essentially vertical member.

In one embodiment, the apparatus is configured such that no tools, other than those fixed to the apparatus, are required to engage or disengage the essentially horizontal member of the movable soccer goal and the fixed, essentially vertical, member extending from the playing surface. In some embodiments, the apparatus is structured to secure the soccer goal by clamping the essentially horizontal member of the movable soccer goal between a portion of the securing device and the outside surface of the vertical post of the football goal.

Embodiments of the invention further provide an apparatus for securing a movable goal to a post of a football goal fixed in the playing surface, where the apparatus includes a post engaging member and a pulling mechanism. The post engaging member includes a hook or hooks formed at one or both ends of the post engaging member. The post engaging member is capable of being placed at least substantially around the post with the end of the hook or hooks capable of engaging a structural member of the movable goal. The pulling mechanism is configured to pull the hook or hooks toward the post to secure the structural member of the movable goal between the hook or hooks and the post.

In some embodiments the pulling mechanism further includes a threaded portion fixed to, or part of, the post engaging member and a bolt extending through the threaded portion. The pulling mechanism is configured such that turning the bolt in one direction applies pressure to a side of the post generally opposite the side of the post where the hook or hooks are located in order to pull the hook or hooks toward the post.

In some embodiments the post engaging member comprises a generally U-shaped member capable of being placed at least substantially around the post. The U-shaped member generally has a first arm and a second arm extending from each end of a curved portion. A hook extends from an end of each of the first and second arms.

Embodiments of the invention further provide an apparatus structured to secure a movable soccer goal to a vertical post of a football goal, said movable soccer goal having a horizontal bar. In one embodiment, the apparatus includes a football goalpost engaging portion, a soccer goal holding portion, and a user-actuable mechanism for coupling the soccer goal holding portion to the football goalpost engaging portion. The football goalpost engaging portion is generally configured to contact a first side of the vertical post. The soccer goal holding portion is coupled to the football goalpost engaging portion and extends away from the football goalpost engaging portion. The apparatus is generally structured such that when the football goalpost engaging portion is in contact with the first side of the vertical post the soccer goal holding portion extends beyond a second side of the vertical post generally opposite said first side and is structured to releasably engage the horizontal bar of the soccer goal. The user-actuable mechanism is structured such that actuation of the mechanism pulls the soccer goal holding portion toward the football goalpost engaging portion.

In one embodiment of the apparatus, the soccer goal holding portion comprises a hook or a pair of hooks. In some embodiments the apparatus comprises a generally U-shaped member comprising a first arm, a second arm, and a rear connecting member joining the first and second arms. In general, the U-shaped member is configured to substantially surround the vertical post. In such embodiments, the soccer goal holding portion comprises a first hook and a second hook, where the first hook extends from the end of the first arm, the second hook extends from the end of the second arm, and the first and second hooks are coupled to the user-actuable mechanism via the generally U-shaped member. In one embodiment, the user-actuable mechanism comprises a threaded aperture through the rear connecting member and a bolt disposed in the threaded aperture. In such an embodiment, the user-actuable mechanism is structured such that, when the apparatus is installed around the vertical post, turning the bolt in a first direction exerts a force against the first side of the vertical post and draws the first and second hooks toward the vertical post.

In one embodiment of the apparatus the soccer goal holding portion comprises a generally hook-shaped member for holding the horizontal bar of the soccer goal. The hook-shaped member has an opening that, when the apparatus is engaged with the football goalpost, faces the football goalpost. In such an embodiment, the apparatus is configured such actuation of the mechanism pulls the soccer hook-shaped member toward the football goalpost and secures the horizontal bar between the hook-shaped member and the second side of the vertical post. In such embodiments the apparatus may further include a protective plate located between the horizontal bar and vertical post, where protective plate has protective padding.

In some embodiments, the user-actuatable mechanism comprises a bolt and the apparatus is structured such that turning the bolt in a first direction exerts a force against the first side of the vertical post and draws the soccer goal engaging portion toward the vertical post. In some embodiments, the football goalpost engaging portion comprises a plate coupled to the bolt and located between the tip of the bolt and the first side of the vertical post. Such a plate has a radius of curvature and is padded on the side of the plate that is configured to be adjacent to the surface of the vertical post. In other embodiments, the football goalpost engaging section comprises the tip of a bolt. In some embodiments, the bolt of the football engaging section has an oversized head that has handgrips to facilitate manual turning of the bolt.

Embodiments of the present invention also provide a method comprising: (1) positioning a movable soccer goal such that a structural member of the soccer goal is located proximate to a vertical post secured in the ground; (2) positioning a soccer goal securing apparatus around the vertical post; (3) positioning a hook-shaped member of the soccer goal securing apparatus around the structural member of the soccer goal; and (4) actuating a user-actuable mechanism of the soccer goal securing apparatus to pull the hook-shaped member of the soccer goal securing apparatus toward the vertical post until the structural member of the soccer goal is secured against the vertical post. In one embodiment, the structural member of the soccer goal comprises a horizontal ground bar of the soccer goal and the vertical post comprises a post of a football goalpost. In some embodiments, the method further comprises positioning a padded member between the structural member of the soccer goal and the vertical post. In some embodiments, actuating the user-actuable mechanism comprises tightening a bolt that is part of the user-actuable mechanism in order to draw the hook-shaped member toward the vertical post.

BRIEF DESCRIPTION OF THE SEVERAL VIEWS OF THE DRAWINGS

Figure 1:
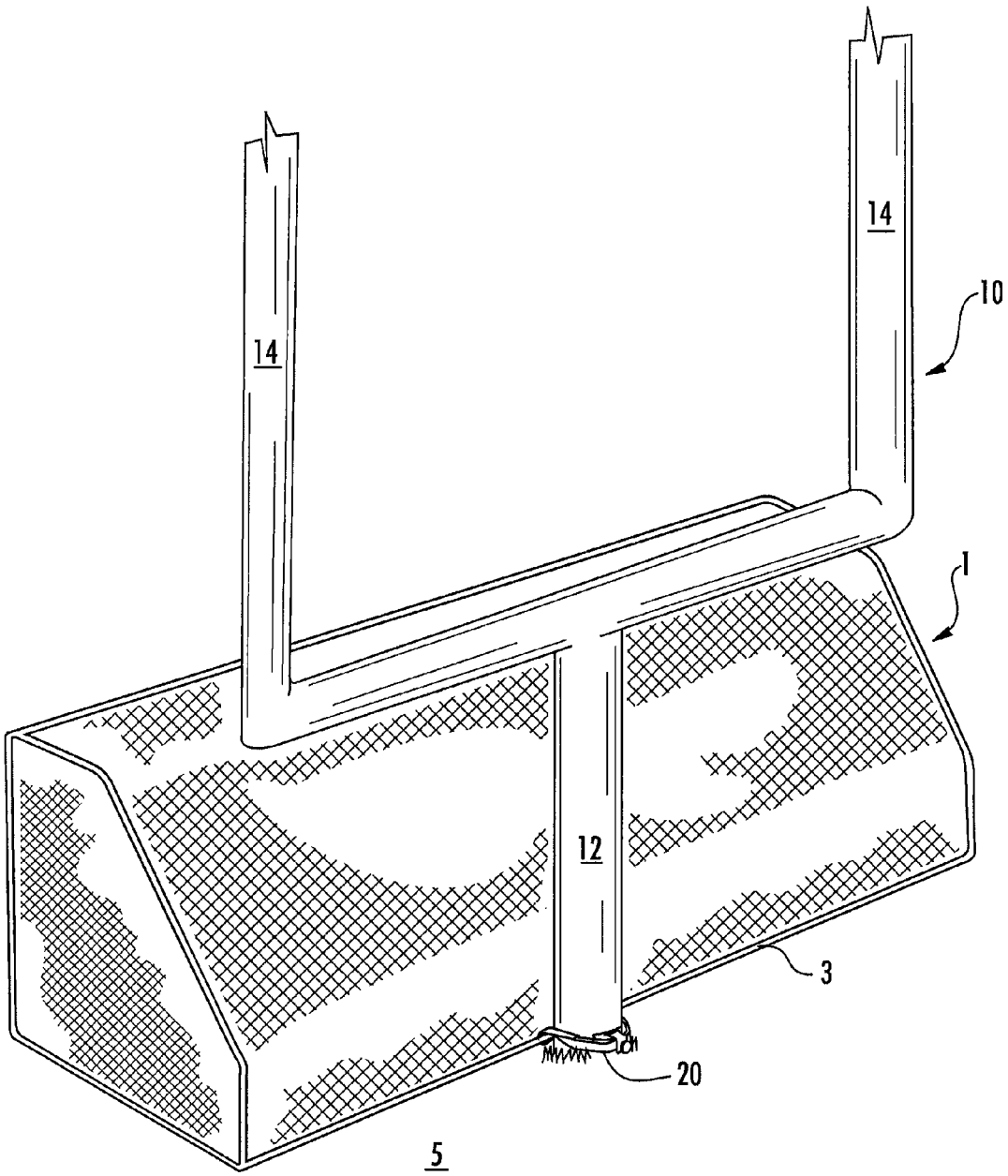
Figure 2:
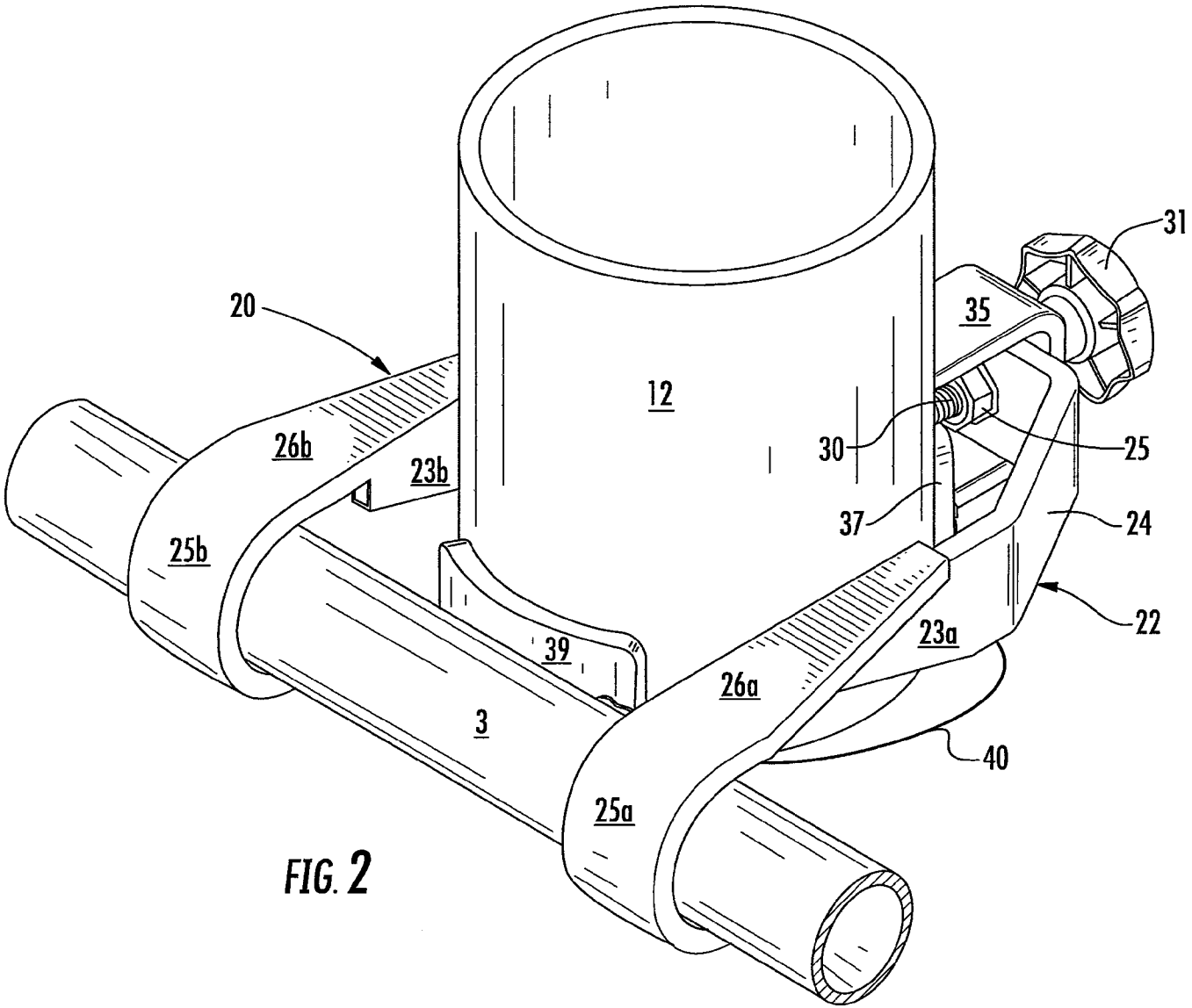
Figure 3:
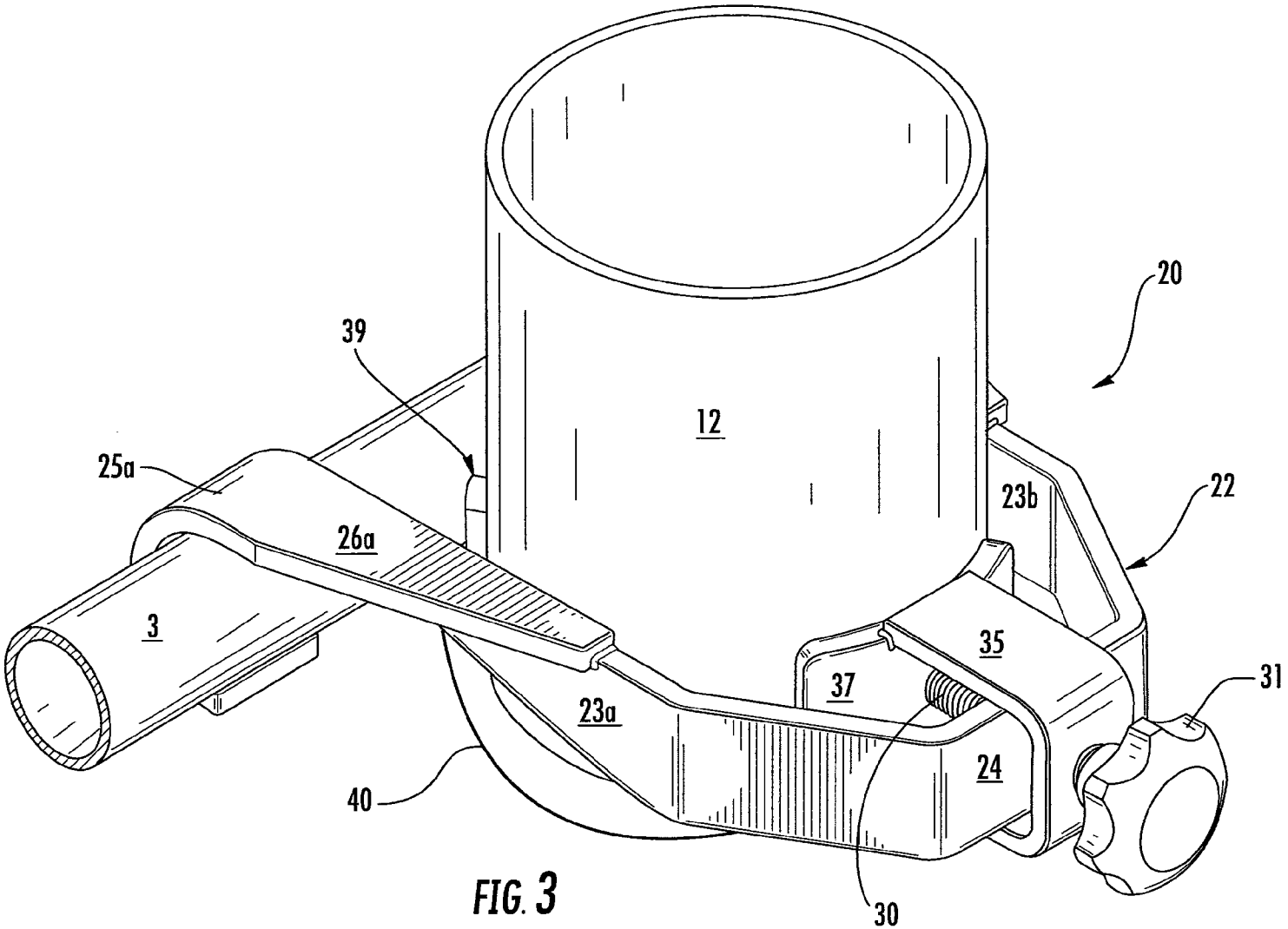
Figure 4:
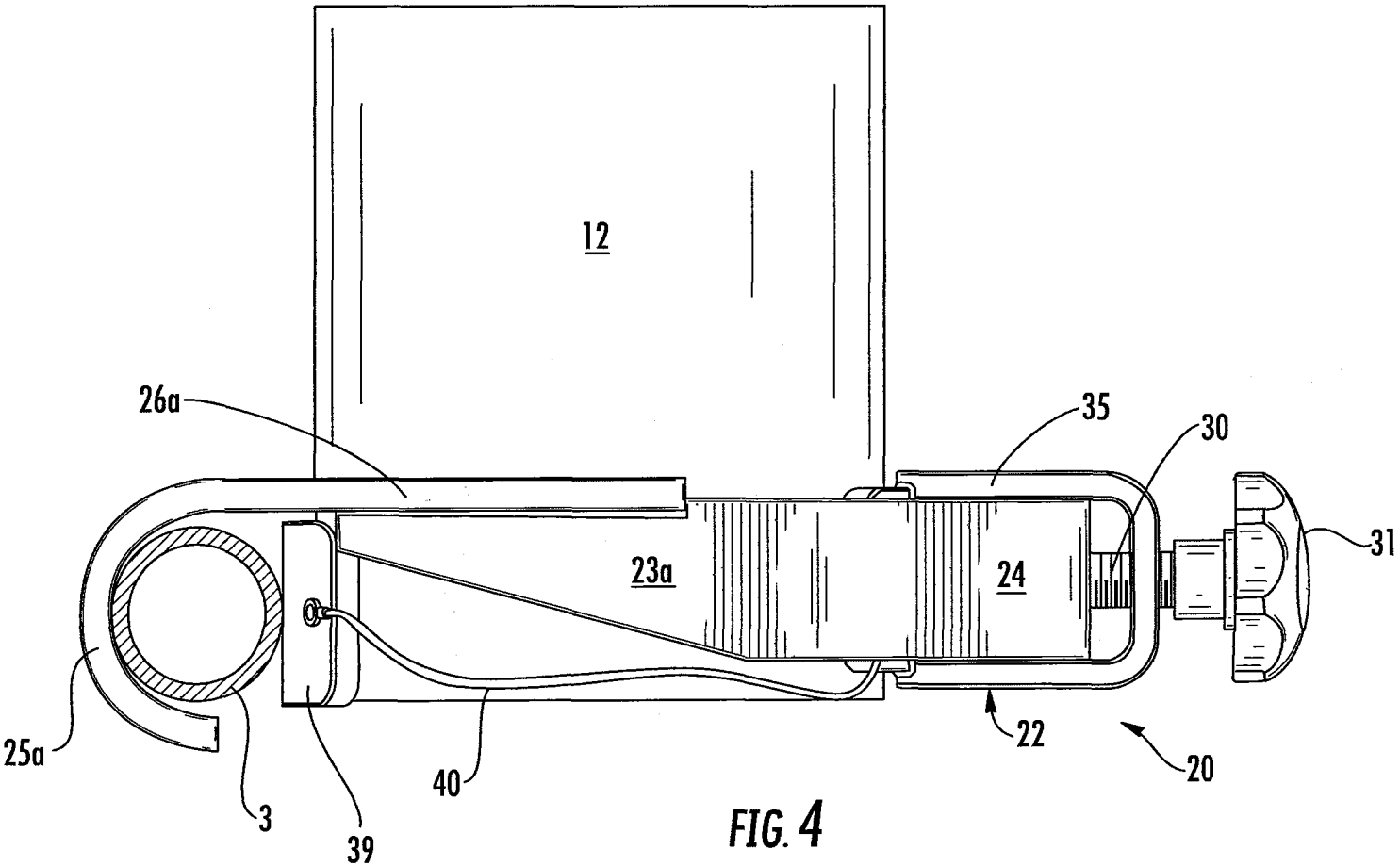
Figure 5:
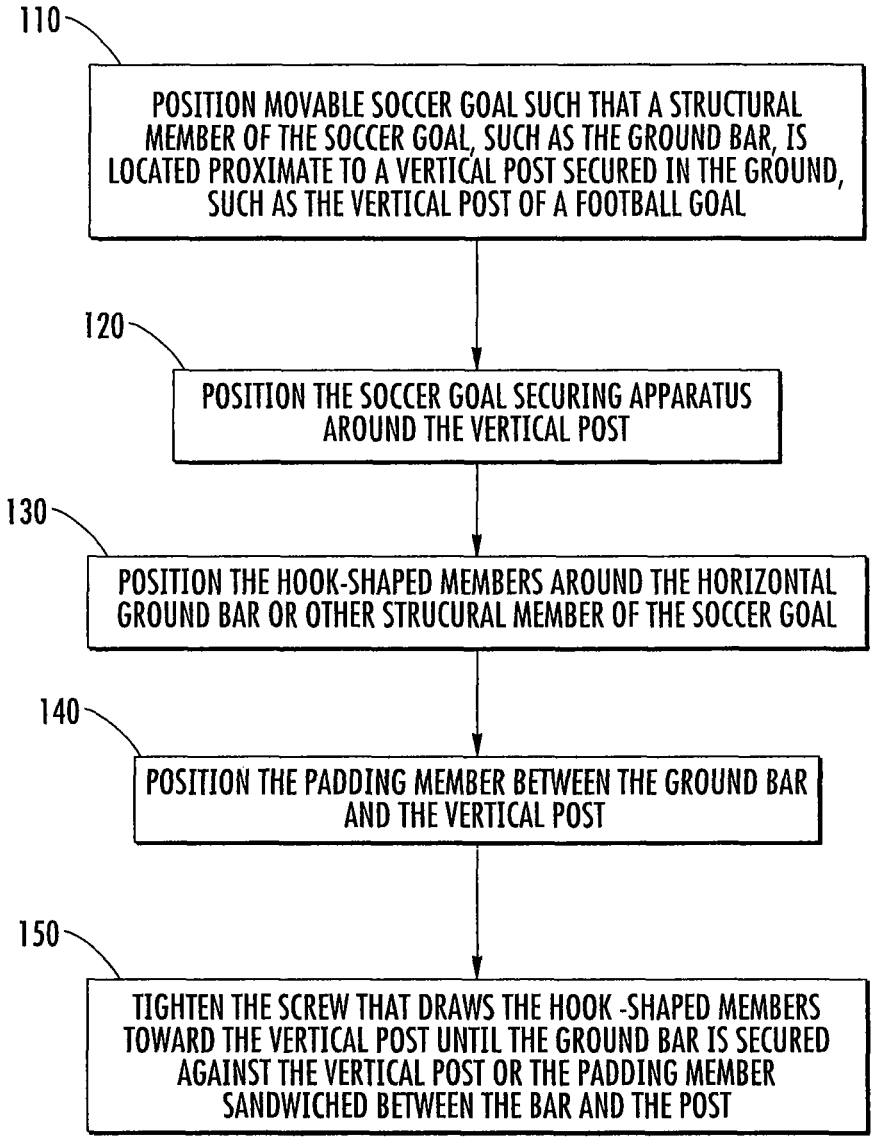

Having thus described embodiments of the invention in general terms, reference will now be made to the accompanying drawings, which are not necessarily draw to scale, and wherein:

FIG. 1 illustrates a perspective view of a soccer goal anchored to a football goal using a soccer goal securing apparatus in accordance with an embodiment of the present invention;

FIG. 2 illustrates a front perspective view of a soccer goal securing apparatus positioned around a vertical member of a football goal and securing the ground bar of a soccer goal to the football goal, in accordance with an embodiment of the present invention;

FIG. 3 illustrates a rear perspective view of the soccer goal securing apparatus of FIG. 2, in accordance with an embodiment of the present invention;

FIG. 4 illustrates a side view of the soccer goal securing apparatus of FIGS. 2 and 3, in accordance with an embodiment of the present invention; and FIG. 5 illustrates a method of anchoring a movable soccer goal in accordance with an embodiment of the present invention.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates a perspective view of a soccer goal 1 anchored to a football goal 10 using a soccer goal securing apparatus 20, in accordance with an embodiment of the present invention. More particularly, in the illustrated embodiment, the soccer goal securing apparatus 20 is configured to engage a lower portion of the vertical post 12 or gooseneck that supports the football crossbar and uprights 14. The soccer goal securing apparatus 20 is further configured to securely hold the horizontal ground bar 3 of the soccer goal 1 at the same time that the soccer goal securing apparatus 20 is engaged with the lower portion of the vertical post 12 of the football goal 10.

As also illustrated in FIG. 1, the soccer goal securing apparatus 20 is positioned at the base of the vertical post 12, just above or on the ground 5 or other playing surface. In this way, the soccer goal securing apparatus 20 anchors the soccer goal's ground bar 3 to the football goal 10 at ground level, while remaining easily accessible to facility personnel who are charged with moving the soccer goal 1 on and off of the football field. It should be noted that, although the embodiments of the present invention generally describe securing the ground bar of the soccer goal to the vertical member of a football goal, in other embodiments a similar apparatus and similar techniques may be applied to securing any soccer like goal to any vertical post. For example, in one embodiment, an indoor soccer goal or floor hockey goal may be secured to the vertical post of a basketball hoop.

FIGS. 2-4 illustrate a front perspective view, a rear perspective view, and a side view, respectively, of a soccer goal securing apparatus 20 positioned around a vertical member 20 of a football goal 10 and securing the ground bar 3 of a soccer goal 1 to the football goal 10, in accordance with an exemplary embodiment of the present invention. As such, the soccer goal securing apparatus 20 generally comprises a soccer goal ground bar holding system for releasably holding the ground bar 3 of a soccer goal 1, and a vertical post engaging system for releasably engaging the vertical post 12 of a football goal 10. The soccer goal securing apparatus 20 also generally comprises one or more releasing mechanisms for releasing the soccer goal's ground bar 3 and the football goal's vertical post 12 from engagement with each other and with the soccer goal securing apparatus 20. In one exemplary embodiment, the soccer goal securing apparatus 20 is configured such that a user can engage and/or disengage the soccer goal's ground bar 3 and the football goal's vertical post 12 without the use of any tools not already coupled to some portion of the soccer goal securing apparatus 20.

In the embodiment illustrated in FIGS. 2-4, the soccer goal securing apparatus 20 comprises a generally "U"-shaped member 22 that is configured to be positioned around the vertical post 12 to removably engage the vertical post 12. More specifically, the U-shaped member 22 includes a first arm 23*a* and a second arm 23*b*. The two arms are connected to each other at one end by a rear connecting member 24 that extends from the rear end of the first arm 23*a* to the rear end of the second arm 23*b*. In this way, the first arm 23*a*, the second arm 23*b*, and the rear connecting member 24 combine to approximately form a "U" shape. In the illustrated embodiment, the first arm 23*a*, the second arm 23*b*, and the rear connecting member 24 are all integrally formed with each other or are at least welded together to form a single unit. However, in other embodiments, the first arm 23*a*, the second arm 23*b*, and the rear connecting member 24 may be joined together using fasteners or other methods or devices that will be apparent to one of ordinary skill in the art in view of this disclosure.

The U-shaped member 22 is configured such that the distance between the first arm 23*a* and the second arm 23*b* is at least as great as, and preferably slightly greater than, the diameter of the vertical post 12. In this way, the U-shaped member 22 can be positioned around the vertical post 12 with the vertical post 12 passing between the two arms 23*a* and 23*b*.

Each arm of the U-shaped member 22 further comprises a mechanism for grasping the generally horizontal ground bar 3 of a soccer goal. In the illustrated embodiment, the ends of the first arm 23*a* and the second arm 23*b* opposite the rear connecting member 24 have generally hook-shaped members 25*a* and 25*b*, respectively, extending therefrom. The generally hook-shaped members 25*a* and 25*b* can be used to engage the ground bar 3 by positioning the hook shaped members 25*a* and 25*b* around the ground bar 3. In one embodiment, the hook-shaped members 25*a* and 25*b* are formed from two generally horizontal plates 26*a* and 26*b* that extend from the first arm 23*a* and the second arm 23*b*, respectively. For example, as illustrated in FIG. 2, the generally horizontal plates 26*a* and 26*b*, which are integrally formed with, welded to, or otherwise coupled to the arms of the U-shaped member 22, extend from the arms of the U-shaped member 22 generally in a plane parallel to the plane defined by the U-shaped member 22 (i.e., a plane generally perpendicular to the longitudinal axis of the vertical post 12 when the soccer goal securing apparatus 20 is installed around the vertical post 12) and curve downward in the direction of the ground to form two hook-shaped half-cylinders 25*a* and 25*b*. The longitudinal axis defined by the first half-cylinder 25*a* aligns with the longitudinal axis defined by the second half-cylinder 25*b*. In this way, the two hook-shaped half cylinders 25*a* and 25*b* can simultaneously grasp two areas of a soccer goal's ground bar 3. In one embodiment, the ground bar 3 is generally cylindrical. In such an embodiment, the hook-shaped half cylinders 25*a* and 25*b* may be configured to have an inside diameter that is only just slightly greater than the diameter of the ground bar 3.

As described above, in the illustrated embodiment, the hook-shaped members 25*a* and 25*b* curve downwards toward the ground. Such a configuration may be preferable since it allows the ground bar 3 to be held close to the ground, as is generally desirable, while the remainder of the soccer goal securing apparatus 20 remains slightly above the ground where it can be more easily adjusted and manipulated by a user without significant interference from the ground. Furthermore, configuring the hook-shaped members 25*a* and 25*b* to curve downwards makes it possible for a user to place the hook-shaped members over the ground bar 3 as opposed to requiring the user to lift the ground bar over the hooks, which would be more difficult for a single person to accomplish. However, despite these potential advantages, in other embodiments of the present invention, the hook-shaped members 25*a* and 25*b* may curve upwards towards the sky.

By positioning the hook-shaped members 25*a* and 25*b* around the ground bar 3, the open end of the U-shaped member 22 is blocked by the ground bar 3. As such, the vertical post 12 is captured between the arms of the U-shaped member 22. In order to secure the ground bar 3 within the hook-shaped members 25*a* and 25*b* and in order to secure the soccer goal securing apparatus 20 with respect to the vertical post 12, the soccer goal securing apparatus 20 further includes a mechanism to draw the hook-shaped members 25*a* and 25*b* toward the vertical post 12 so that the ground bar 3 is secured between the hook-shaped members and the vertical post 12 (or some other member positioned between the ground bar 3 and the vertical post 12, as described below with regard to an exemplary embodiment of the invention).

In the illustrated embodiment, the rear connecting member 24 has a nut 25 welded or otherwise coupled thereto. In other embodiments, however, the rear connecting member 24 may be threaded and the nut 25 may not be required. Where a nut is used, the nut 25 is preferably welded approximately halfway between the two arms of the U-shaped member 22. The interior of the nut 25 is threaded so that a bolt 30 can be screwed through the nut towards the interior of the "U" defined by the U-shaped member 22. The head of the bolt 30 is located outside of the "U," i.e., to the rear of the rear connecting member 24. As illustrated in FIGS. 2-4, the head of the bolt 30 may include an enlarged knob 31 designed so that the bolt 30 can be more easily turned by hand.

The illustrated embodiment further includes a clamping plate 37 which is held in place in front of the bolt 30 by a second U-shaped member 35 welded or otherwise coupled thereto. As illustrated in FIG. 3, when the clamping plate 37 is welded to the second U-shaped member 35, the two define a generally rectangular-shaped tube. The rear connecting member 24 passes through this tube and the second U-shaped member 35 has a hole therein to allow for the bolt 30 to pass therethrough uninhibited to the nut 25 in the rear connecting member 24. Configured as such, the bolt 30 can be turned in a clockwise direction to advance the bolt 30 through the nut 25 and toward the clamping plate 37. When the bolt 30 intersects the clamping plate 37, further turning of the bolt 30 pushes the clamping plate 37 and the rear connecting member 24 apart from each other. When the soccer goal securing apparatus is positioned around the vertical post 12 and when the clamping plate 37 is positioned adjacent to the outside surface of the vertical post 12, further turning of the screw in the clockwise direction causes the U-shaped member, including the arms 23*a*/23*b* and the hooks 25*a*/25*b* to move toward the rear, thereby drawing the ground bar 3 of the soccer goal closer and closer to the vertical post 12 until the portion of the ground bar 3 between the two hook-shaped members 25*a* and 25*b* is secured against the vertical post 12.

In one embodiment of the invention, the clamping plate 37 has a curvature that at least approximately matches the curvature of the post 12 or of a standard vertical post of a football goal. In other embodiments, however, the clamping plate 37 may be flat or take other forms. In some embodiments, at least the portion of the clamping plate 37 that interacts with the post 12 is made of, lined with, or coated with a soft and/or resilient material that functions to help protect the post 12 from being scratched or otherwise damaged from the clamping plate 37.

As illustrated in FIGS. 2-4, the soccer goal securing apparatus 20 further comprises a protecting plate or pad 39 for positioning between the ground bar 3 and the post 12 when the ground bar 3 is pulled rearward against the post 12. The plate or pad 39 may have a curvature, at least on the side that interacts with the post 12, that at least approximately matches the curvature of the post 12. One or both of the sides of the plate or pad 39 may be lined with, covered with, or made of a soft and/or resilient material that functions to help protect the post 12 and/or the ground bar 3 from being scratched, dented, or otherwise damaged when the ground bar 3 and the post 12 are pulled together. For example, in an exemplary embodiment of the invention, the plate 39 is made up of a curved metal plate having foam or rubber lining the inside of the curvature.

In some embodiments, the protecting plate or pad 39 is not attached to the U-shaped member 22 or other members of the soccer goal securing apparatus 20. In other embodiments, however, the protecting plate or pad 39 is attached to the U-shaped member 22. For example, in the embodiment illustrated in FIGS. 2-4, the protecting plate 39 is attached to the rear clamping plate 37 via a tether 40. The tether 40 may comprise, for example, a flexible metal cable.

In another exemplary embodiment of the present invention, the second U-shaped member 35 and the rear clamping plate 37 are not present. In such an embodiment, the bolt 30, threaded through the rear connecting member 24 and/or a nut 25 welded thereto, may be used to bear directly against the surface of the post 12 and push the rear connecting member 24 away from the post 12 when the bolt 30 is turned in a predefined direction. In still other embodiments, a clamping plate 37 is rotatably coupled, such as by a ball-and-socket-type hinge, to the tip of the bolt 30, but the second U-shaped member 35 is not present.

In yet another embodiment, other mechanisms for drawing the hook members 25*a* and 25*b* toward the vertical post 12 may be provided. For example, each arm 23*a* and 23*b* may be coupled to the rear connecting member 24 via a first bolt and a second bolt, respectively. Turning each of these two bolts in a predetermined direction may pull the corresponding arm rearward toward the rear connecting member 24. When the rear connecting member 24 is resting against the rear of the vertical post 12, turning of the bolts in this predetermined direction pulls the hook-shaped members 25*a* and 25*b*, and any horizontal bar 3 held thereby, towards the post 12.

In some embodiments, the soccer goal securing apparatus 20 is made primarily of metal. However, in other embodiments, the soccer goal securing apparatus 20 may be made of any suitable polymeric or metallic material or any combination of these or other materials. As described above, in some embodiments, portions of the soccer goal securing apparatus 20 are made of, lined with, or coated with relatively soft, flexible, and/or resilient material to protect the post 12 and/or the ground bar 3 from damage. For example, in one embodiment, the hook-shaped members 25*a* and 25*b* are coated with a rubber-like material or lined on the inside of the curvature with a foam or rubber-like material.

Embodiments of the present invention further provide a method of anchoring a movable soccer goal. For example, FIG. 5 illustrates a method of anchoring a moveable soccer goal to the ground, in accordance with an embodiment of the present invention. Specifically, as illustrated by block 110, the method may involve positioning a movable soccer goal such that a structural member of the soccer goal, such as the ground bar, is located proximate to a vertical post secured in the ground, such as the vertical post of a football goal. As illustrated by block 120, the method may further involve positioning a soccer goal securing apparatus around the vertical post and, as illustrated by block 130, positioning one or more hook-shaped members of the soccer goal securing apparatus around the horizontal ground bar or other structural member of the soccer goal. As illustrated by block 140, the method may further involve positioning a padding member between the ground bar and the vertical post. As illustrated by block 150, the method may then further involve tightening a bolt of the soccer goal securing apparatus to draw the one or more hook-shaped members toward the vertical post until the soccer goal's ground bar is secured against the vertical post or against the padding member sandwiched between the ground bar and the post.

Specific embodiments of the invention are described herein. Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A sporting system, comprising:

a football goal, the football goal comprising a tubular gooseneck member extending from a playing surface, the gooseneck member defining first and second sides;

a movable soccer goal, the movable soccer goal being positioned on the first side of the gooseneck member of the football goal, the movable soccer goal comprising a tubular frame, the tubular frame comprising at least one horizontal member;

an apparatus to secure at least a portion of the frame of the movable soccer goal to the gooseneck member of the football goal, the apparatus comprising:

a post engaging member capable of removably engaging the horizontal member of the frame of the movable soccer goal, wherein the post engaging member comprises a first U-shaped member having a first arm and second arm that are connected to each other by a rear connecting member that defines an aperture therethrough, wherein the first U-shaped member is configured to be positioned around a portion of the gooseneck member for removably engaging the gooseneck portion and wherein ends of each of the first arm and second arm opposite the rear connecting member each have a hook-shaped member extending therefrom for engaging at least a portion of the frame of the movable soccer goal;

a second U-shaped member positioned around the rear connecting member of the first U-shaped member, the second U-shaped member defining an aperture therethrough, the second U-shaped member having a first arm and second arm that are connected to each other by a plate, the plate being configured to contact the gooseneck member of the football goal; and a pulling mechanism comprising a rotatable threaded member extending through the aperture in the second U-shaped member and threaded through the aperture in the rear connecting member of the first U-shaped member, wherein rotation of the threaded member in a first direction urges the hook-shaped members of the post engaging member toward the first side of the gooseneck member of the football goal and urges the plate toward the second side of the gooseneck member of the football goal to secure at least a portion of the frame of the soccer goal between the hook-shaped members of the post engaging member and the first side of the gooseneck member of the football goal.

2. The apparatus of claim 1, wherein the threaded member intersects the plate.

3. The apparatus of claim 2, wherein the plate has an exterior configuration corresponding to an exterior configuration of the gooseneck member of the football goal.

4. The apparatus of claim 1, further comprising a protective plate position on the first side of the gooseneck member of the football goal to prevent contact between the frame of the movable soccer goal and the gooseneck member of a football goal.

5. The apparatus of claim 4, wherein the protective plate has an exterior configuration corresponding to an exterior configuration of the gooseneck member of the football goal.

6. The apparatus of claim 1, wherein rotation of the threaded member in a second direction urges the at least one hook-shaped member of the post engaging member away from the first side of the gooseneck member of the football goal.

7. A method of installing a sporting system, the method comprising:

providing a football goal, the football goal comprising a tubular gooseneck member extending from a playing surface, the gooseneck member defining first and second sides;

providing a movable soccer goal, the movable soccer goal being positioned on the first side of the gooseneck member of the football goal, the movable soccer goal comprising a tubular frame, the tubular frame comprising at least one horizontal member;

providing a securing apparatus comprising:

a post engaging member capable of removably engaging the horizontal member of the frame of the movable soccer goal, wherein the post engaging member comprises a first U-shaped member having a first arm and second arm that are connected to each other by a rear connecting member that defines an aperture therethrough, wherein the first U-shaped member is configured to be positioned around a portion of the gooseneck member for removably engaging the gooseneck portion and wherein ends of each of the first arm and second arm opposite the rear connecting member each have a hook-shaped member extending therefrom for engaging at least a portion of the frame of the movable soccer goal;

a second U-shaped member positioned around the rear connecting member of the first U-shaped member, the second U-shaped member defining an aperture therethrough, the second U-shaped member having a first arm and second arm that are connected to each other by a plate, the plate being configured to contact the gooseneck member of the football goal; and a pulling mechanism comprising a rotatable threaded member extending through the aperture in the second U-shaped member and threaded through the aperture in the rear connecting member of the first U-shaped member;

positioning the movable soccer goal such that a horizontal member of the movable soccer goal is located proximate to the first side of the gooseneck member of the football goal;

positioning the hook-shaped members at least partially around the horizontal member of the movable soccer goal;

rotating the threaded member in a first direction to thereby urge the at least one hook-shaped member of the post engaging member toward the first side of the gooseneck member of the football goal and urge the plate toward the second side of the gooseneck member of the football goal.

8. The method of claim 7, further comprising rotating the threaded member in a second direction to thereby urge the at least one hook-shaped member of the post engaging member away from the first side of the gooseneck member of the football goal.

* * * * *